US008186974B2

(12) United States Patent
Lan et al.

(10) Patent No.: US 8,186,974 B2
(45) Date of Patent: May 29, 2012

(54) FAN AND FAN HOUSING WHICH DRAINS MOISTURE IN THE FAN HOUSING

(75) Inventors: Chung-Kai Lan, Taoyuan Hsien (TW); Chen-Mo Jiang, Taoyuan Hsien (TW); Hung-Chi Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 589 days.

(21) Appl. No.: 12/397,900

(22) Filed: Mar. 4, 2009

(65) Prior Publication Data

US 2010/0166580 A1 Jul. 1, 2010

(30) Foreign Application Priority Data

Dec. 31, 2008 (TW) ..... 97151511 A

(51) Int. Cl.
*F04B 35/04* (2006.01)

(52) U.S. Cl. ..... 417/423.14

(58) Field of Classification Search ..... None
See application file for complete search history.

(56) References Cited

U.S. PATENT DOCUMENTS

| | | | | |
|---|---|---|---|---|
| 3,763,660 | A * | 10/1973 | Burney | 62/280 |
| 6,110,035 | A * | 8/2000 | Uemura et al. | 454/121 |
| 6,443,714 | B1 * | 9/2002 | Hollenbeck et al. | 417/423.1 |
| 6,877,550 | B2 * | 4/2005 | Shikata et al. | 165/43 |
| 7,362,021 | B2 * | 4/2008 | Huang et al. | 310/88 |
| 2002/0011325 | A1 * | 1/2002 | Shikata et al. | 165/43 |
| 2002/0129931 | A1 * | 9/2002 | Nagata et al. | 165/202 |
| 2007/0110572 | A1 * | 5/2007 | Lan et al. | 415/203 |
| 2008/0003101 | A1 * | 1/2008 | Lan et al. | 415/203 |

* cited by examiner

*Primary Examiner* — Toan Ton
*Assistant Examiner* — Britt D Hanley
(74) *Attorney, Agent, or Firm* — Muncy, Geissler, Olds & Lowe, PLLC

(57) ABSTRACT

A fan includes a fan housing, a motor and an impeller. The fan housing includes a first pressure area, a second pressure area and a guiding portion. The pressure of the first pressure area is higher than the pressure of the second pressure area. The guiding portion has a first end and a second end, the first end of the guiding portion is disposed at the first pressure area and the second end of the guiding portion is disposed at the second pressure area for draining moisture gathered in the fan housing away from the first pressure area to the second pressure area. The motor is disposed in the fan housing, and the impeller is connected with the motor.

17 Claims, 4 Drawing Sheets

FAN AND FAN HOUSING WHICH DRAINS MOISTURE IN THE FAN HOUSING

CROSS REFERENCE TO RELATED APPLICATIONS

This Non-provisional application claims priority under 35 U.S.C. §119(a) on Patent Application No(s). 097151511, filed in Taiwan, Republic of China on Dec. 31, 2008, the entire contents of which are hereby incorporated by reference.

BACKGROUND OF THE INVENTION

1. Field of Invention

The present invention relates to a fan and fan housing, and in particular to a fan housing capable of draining moisture gathered in the fan housing away.

2. Related Art

Normally, the car nowadays has an air conditioner for making the driver and the passengers comfortable. The air conditioner is usually disposed in the nacelle, and the cool air or the heating generated by the air conditioner is flowing into the cabin by a fan and through a duct. Therefore, it is important to provide a good airflow blowing device for the air conditioner of a car.

The conventional inlet of the fan for airflow blowing of the air conditioner of a car is located above the impeller of the fan, when it is raining or snowing, moisture will be guided into the fan with the airflow by the impeller and be gathered together in the bottom of the fan, and accumulated water will be formed thereto.

For draining away the accumulated water in the bottom of the fan, an opening is disposed at the bottom of the fan as an outlet. But if there are some important components of the car disposed under the fan, the reliability of the car may be reduced.

SUMMARY OF THE INVENTION

The present invention is to provide a fan and fan housing capable of draining moisture gathered in the fan housing away.

To achieve the above, the present invention discloses a fan, which includes a fan housing, a motor and an impeller. The fan housing includes a first pressure area, a second pressure area and a guiding portion. The pressure of the first pressure area is higher than the pressure of the second pressure area. The guiding portion has a first end and a second end, the first end of the guiding portion is disposed at the first pressure area and the second end of the guiding portion is disposed at the second pressure area for draining moisture gathered in the fan housing away from the first pressure area to the second pressure area. The motor is disposed in the fan housing, and the impeller is connected with the motor.

The fan and fan housing of the present invention is capable of scattering the moisture by the guiding portion as well as the siphonal effect and Bernoulli equation, so as to prevent moisture guided from external environment from entering into other components of the car.

BRIEF DESCRIPTION OF THE DRAWINGS

The present invention will be fully understood from the subsequent detailed description and accompanying drawings, which are given by way of illustration only, and thus are not limitative of the present invention, and wherein.

DETAILED DESCRIPTION OF THE INVENTION

The preferred embodiments of a fan and fan housing of the present invention will be apparent from the following detailed description, which proceeds with reference to the accompanying drawings, wherein the same references relate to the same elements.

Figure 1:
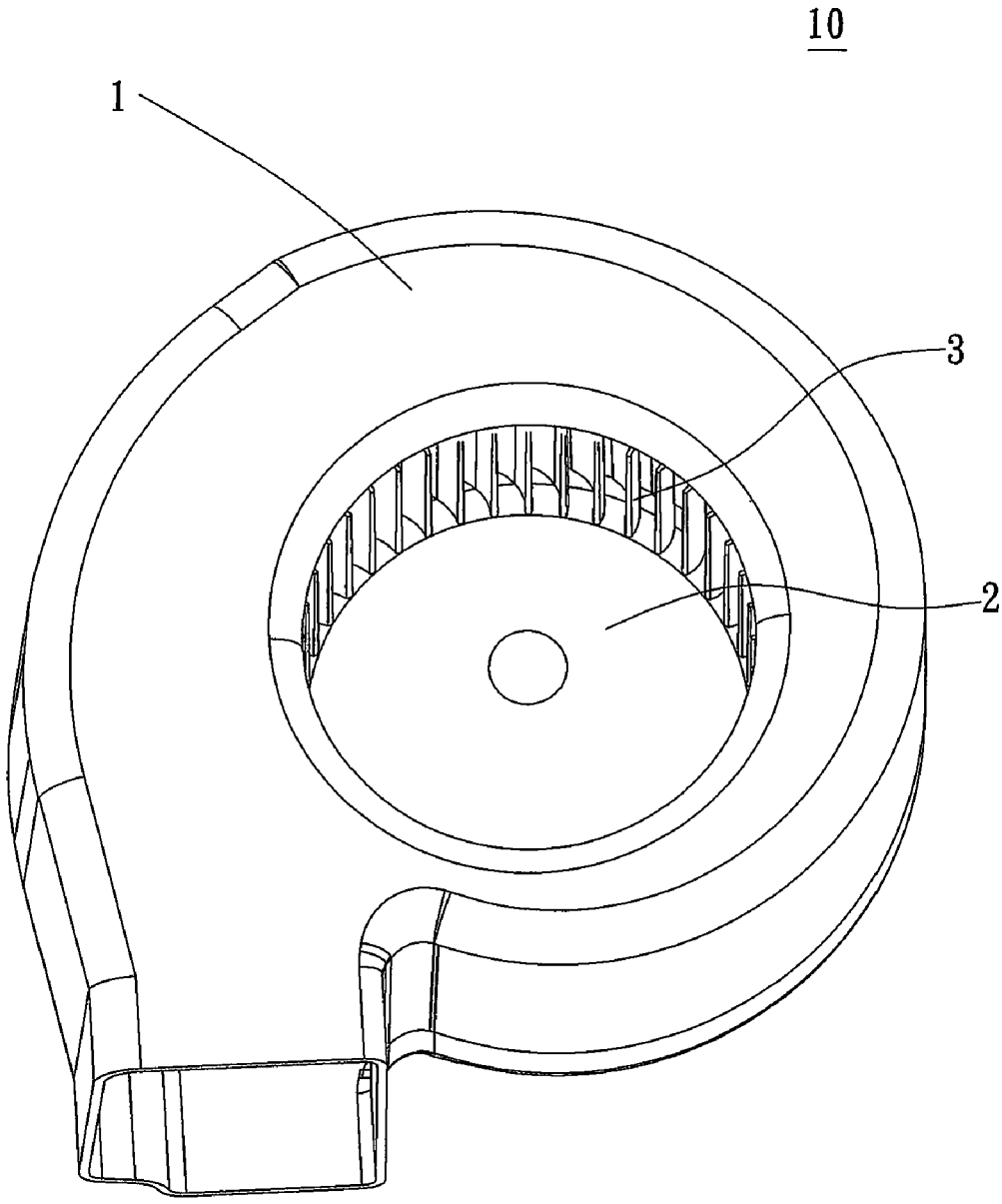
FIG. 1 is a three-dimensional illustration showing a fan and its fan housing according to a preferred embodiment of the present invention.
Figure 2:
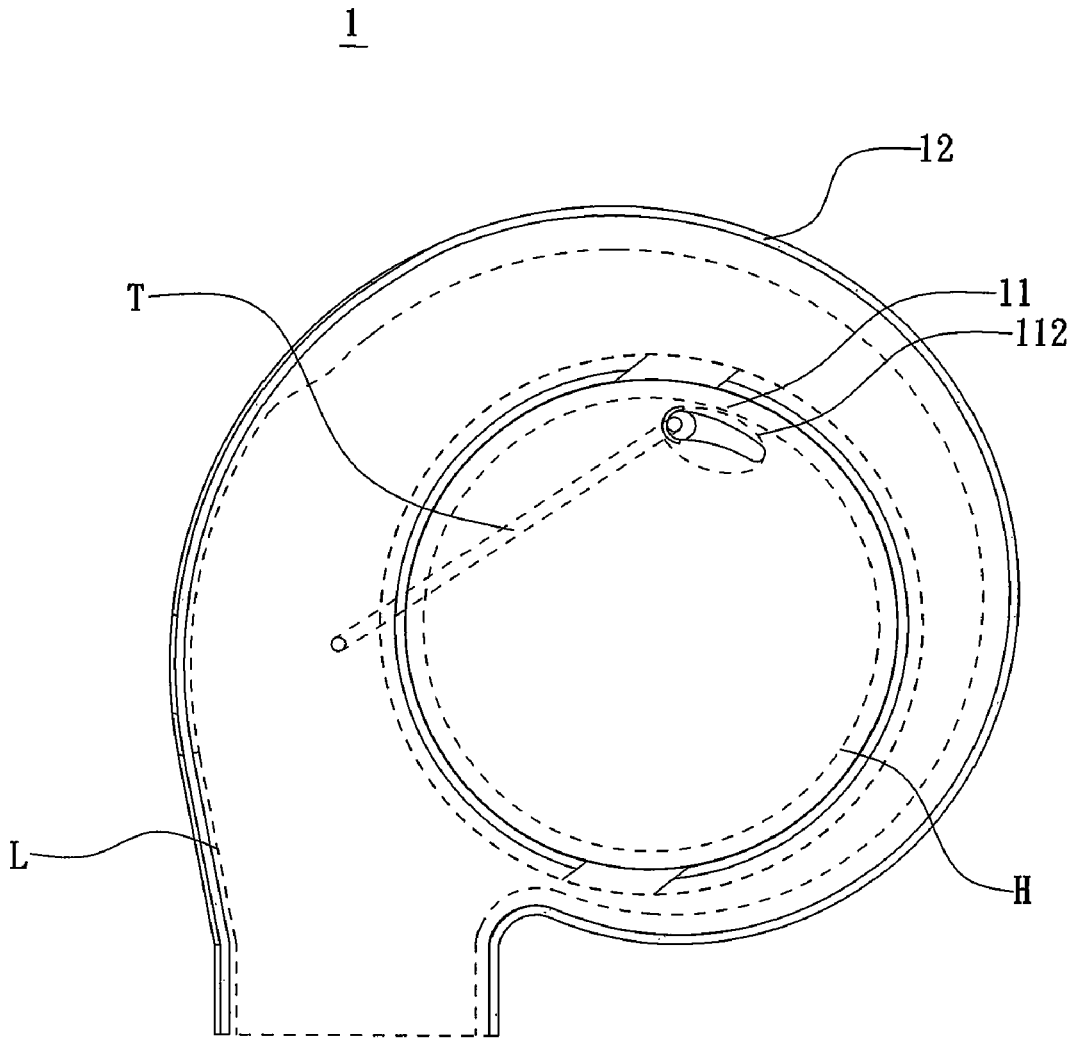
FIG. 2 is a perspective view of the fan housing in FIG. 1.
Figure 3:
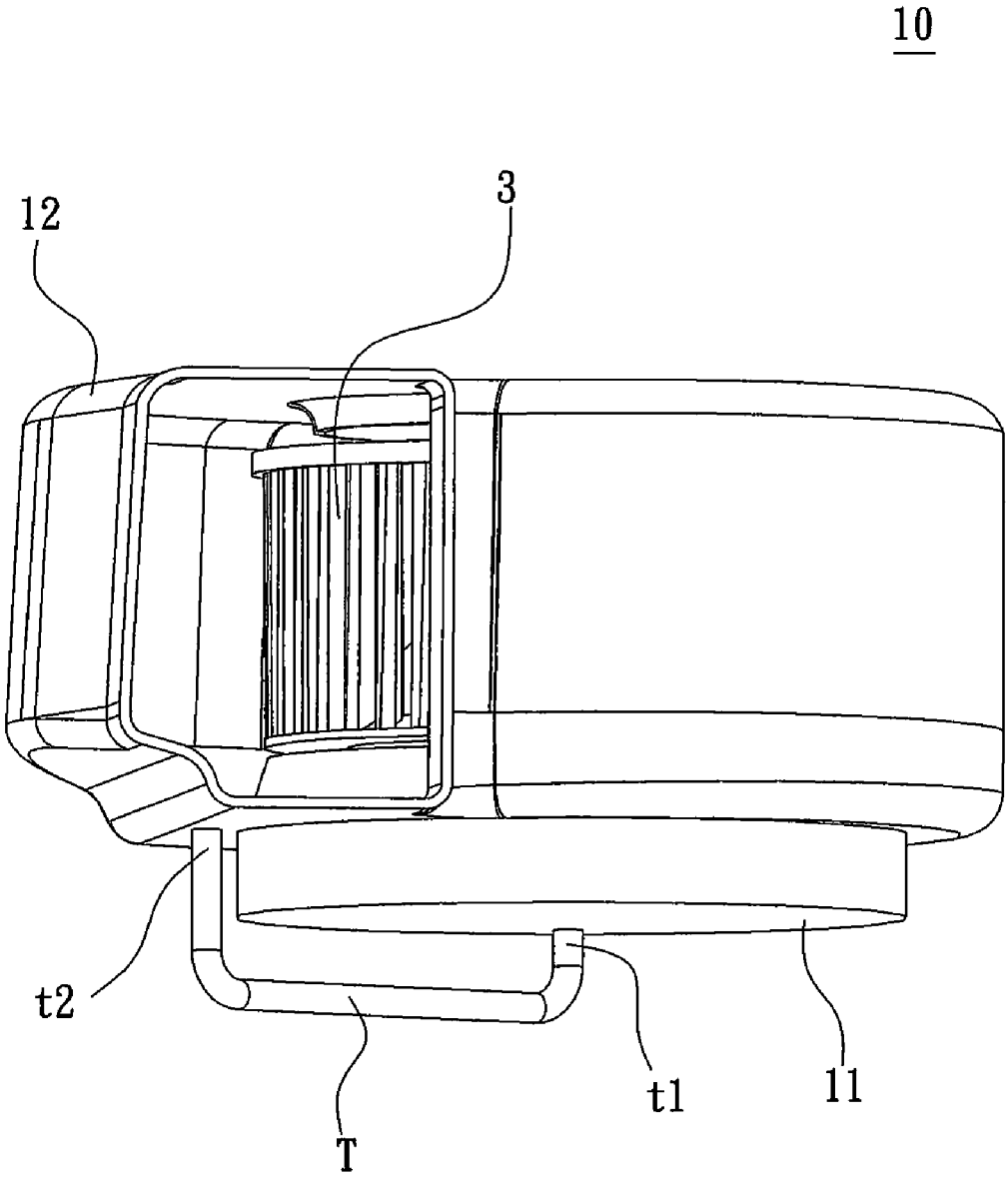
FIG. 3 is side elevation of the fan and its fan housing in FIG. 1.

Please refer to FIG. 1, FIG. 2 and FIG. 3, a fan 10 according to a preferred embodiment of the present invention includes a fan housing 1, a motor 2 and an impeller 3. The fan housing 1 includes a first pressure area H, a second pressure area L and a guiding portion T. The pressure of the first pressure area H is higher than the pressure of the second pressure area L. The guiding portion T has a first end t1 and a second end t2, the first end t1 of the guiding portion T is disposed at the first pressure area H, and the second end t2 of the guiding portion T is disposed at the second pressure area L, for draining moisture gathered in the fan housing 1 away from the first pressure area H to the second pressure area L. The motor 2 is disposed in the fan housing 1. The impeller 3 is connected with the motor 2, and the fan 10 of the present invention is preferably a centrifugal fan applied to an air conditioner of a car.

Figure 4:
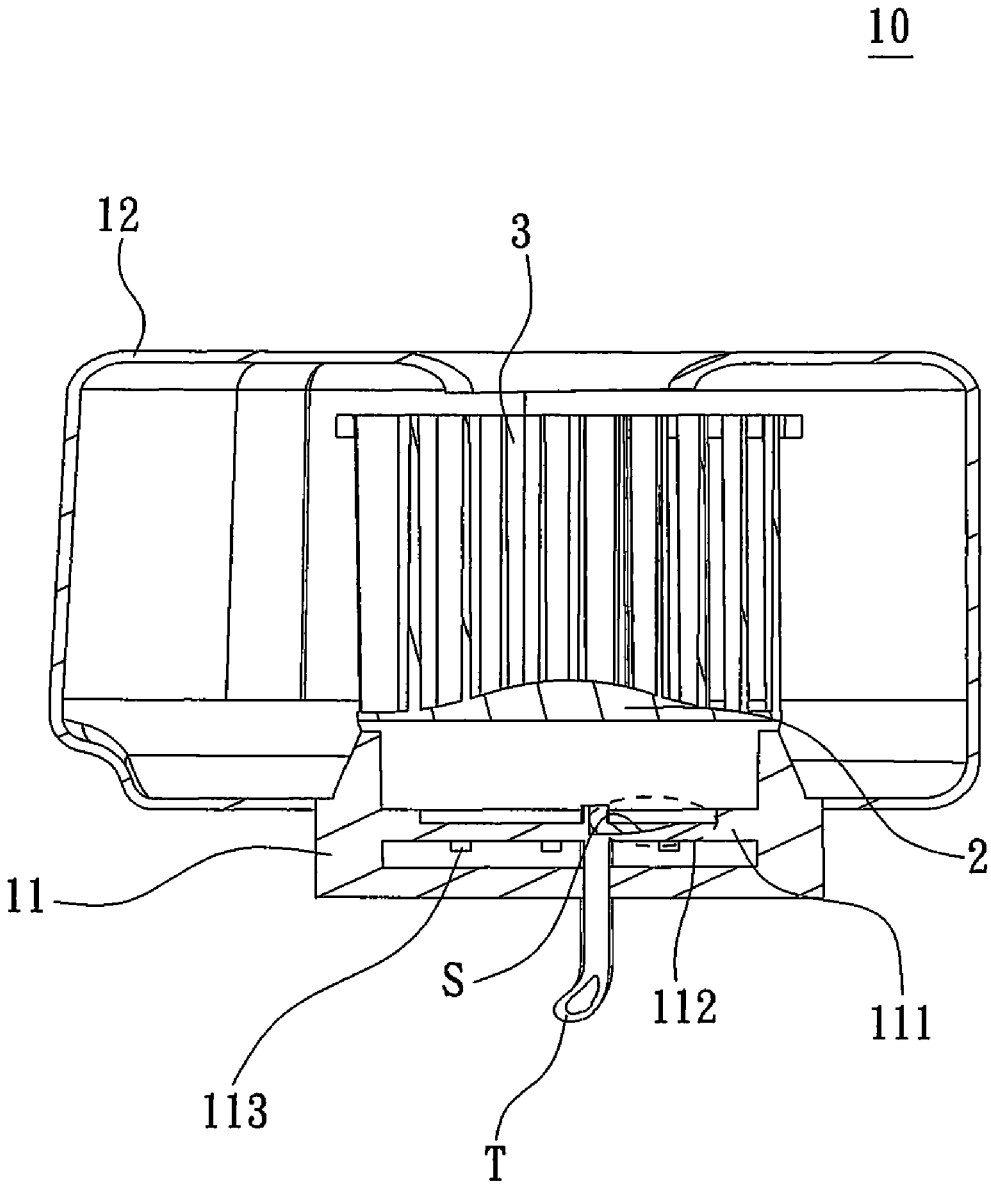
FIG. 4 is a section view of the fan and its fan housing in FIG. 1.

Please refer to FIG. 2 and FIG. 4, the fan housing 1 further includes a motor base 11 and a main body 12, the first pressure area H is located at the bottom of the motor base 11, and the second pressure area L is located at a flowing path of the main body 12. The motor base 11 has a loading portion 111, and the motor 2 is disposed on the loading portion 111. The first pressure area H includes a moisture collecting part 112 disposed at the loading portion 111, and the moisture collecting part 112 is concave and has an inclined plane S. After the moisture is guided into the fan housing 1 by the impeller 3, the moisture will be collected in the moisture collecting part 112 along the inclined plane S. The first end t1 of the guiding portion T is disposed at the bottom of the moisture collecting part 112 of the first pressure area H, and the second end t2 of the guiding portion T is connected with the main body 12.

According to Bernoulli equation, when the fan 10 operates, the airflow pass through the second pressure area L, so that the pressure of the second pressure area L is lower than the pressure of the first pressure area H, and there is a pressure difference between the first end t1 and the second end t2 of the guiding portion T. Because of the siphonal effect, the moisture can be guided from the first end t1 of the guiding portion T to the second end t2 of the guiding portion T, and then the moisture will be scattered by the rotation of the impeller 3.

In addition, the cross section of the moisture collecting part 112 can be circular, semicircular, oval, semi-oval or water drop shaped, and the moisture collecting part 112 can collects the moisture effectively by the inclined plane S. An electronic element 113 for driving the motor 2 is disposed on a side distant from the moisture collecting part 112 of the loading portion 111. When the guiding portion T is a single pipe, the first end t1 pass through the bottom of the motor base 11 and is connected with the opening of the bottom of the moisture collecting part 112, the second end t2 pass through the main body 12 of the fan housing 1 and is connected with the flowing path of the main body 12. Or, the guiding portion T can be a pipe unitary in construction with the fan housing 1.

In summary, the fan and fan housing of the present invention can be applied to an air conditioner of a car and is capable of scattering the moisture out of the conditioner by the guiding portion as well as the siphonal effect and Bernoulli equation, so as to prevent moisture guided from external environment by the air conditioner from permeating into other components of the car (such as engine or circuit system).

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan housing, comprising: a first pressure area; a second pressure area, wherein a pressure of the first pressure area is higher than a pressure of the second pressure area; a guiding portion comprising a first end disposed at the first pressure area and a second end disposed at the second pressure area, for draining moisture gathered in the fan housing away from the first pressure area to the second pressure area; and further comprising a main body, wherein the second pressure area is located at a flowing path of the main body, and the second end of the guiding portion is connected with the main body and wherein the second pressure area surrounds the first pressure area.

2. The fan housing according to claim 1, further comprising a motor base, and the first pressure area is located at a bottom of the motor base and wherein moisture gathered in the fan housing is moved to the second pressure area using the Bernoulli effect.

3. The fan housing according to claim 2, wherein the motor base further comprises a loading portion, the first pressure area further comprises a moisture collecting part disposed at the loading portion, and the moisture collecting part is concave.

4. The fan housing according to claim 3, wherein the moisture collecting part further comprises an inclined plane.

5. The fan housing according to claim 3, wherein the first end of the guiding portion is disposed at the bottom of the moisture collecting part of the first pressure area.

6. The fan housing according to claim 5, wherein a cross section of the moisture collecting part is circular, semicircular, oval, semi-oval or water drop shaped.

7. The fan housing according to claim 3, wherein an electronic element is disposed on a side distant from the moisture collecting part of the loading portion.

8. The fan housing according to claim 1, wherein the guiding portion is a single pipe or a pipe unitary in construction with the fan housing and wherein a mid-portion of the guiding portion is horizontal.

9. The fan housing according to claim 1, wherein the fan housing is applied to a centrifugal fan.

10. A fan, comprising: a fan housing, the fan housing comprising: a first pressure area; a second pressure area, wherein a pressure of the first pressure area is higher than a pressure of the second pressure area; a guiding portion comprising a first end disposed at the first pressure area and a second end disposed at the second pressure area, for draining moisture gathered in the fan housing away from the first pressure area to the second pressure area; a motor disposed in the fan housing; and an impeller connected with the motor; and wherein the fan housing further comprises a main body, wherein the second pressure area is located at a flowing path of the main body, and the second end of the guiding portion is connected with the main body and wherein the second pressure area surrounds the first pressure area.

11. The fan according to claim 10, wherein the fan housing further comprises a motor base, and the first pressure area is located at a bottom of the motor base and wherein moisture gathered in the fan housing is moved to the second pressure area using the Bernoulli effect.

12. The fan according to claim 11, wherein the motor base further comprises a loading portion, the first pressure area further comprises a moisture collecting part disposed at the loading portion, and the moisture collecting part is concave.

13. The fan according to claim 12, wherein the moisture collecting part further comprises an inclined plane.

14. The fan according to claim 13, wherein the first end of the guiding portion is disposed at the bottom of the moisture collecting part of the first pressure area.

15. The fan according to claim 12, wherein an electronic element is disposed on a side distant from the moisture collecting part of the loading portion.

16. The fan according to claim 10, wherein the guiding portion is a single pipe or a pipe unitary in construction with the fan housing and wherein a mid-portion of the guiding portion is horizontal.

17. The fan according to claim 10, wherein the fan is a centrifugal fan applied to an air conditioner of a car.

* * * * *